US010125753B2

(12) United States Patent
Poertner

(10) Patent No.: US 10,125,753 B2
(45) Date of Patent: Nov. 13, 2018

(54) MAGNETIC COUPLER FOR AIR PUMP HOSE FITTING

(71) Applicant: Aeromind, LLC, Indianapolis, IN (US)

(72) Inventor: Joshua Poertner, Indianapolis, IN (US)

(73) Assignee: Aereomind, LLC, Indianapolis, IN (US)

( * ) Notice: Subject to any disclaimer, the term of this patent is extended or adjusted under 35 U.S.C. 154(b) by 310 days.

(21) Appl. No.: 15/080,561

(22) Filed: Mar. 24, 2016

(65) Prior Publication Data

US 2016/0281702 A1 Sep. 29, 2016

Related U.S. Application Data

(60) Provisional application No. 62/138,140, filed on Mar. 25, 2015.

(51) Int. Cl.
*F04B 33/00* (2006.01)

(52) U.S. Cl.
CPC ..... *F04B 33/005* (2013.01)

(58) Field of Classification Search
CPC ..... B25B 11/002
See application file for complete search history.

(56) References Cited

U.S. PATENT DOCUMENTS

| | | | | |
|---|---|---|---|---|
| 5,137,430 | A | 8/1992 | Alioto | |
| 5,890,725 | A | 4/1999 | Wood | |
| 9,093,206 | B2 * | 7/2015 | Davis | B65D 43/0202 |
| 9,140,393 | B2 * | 9/2015 | Wolff | F16L 37/004 |
| 2008/0014098 | A1 | 1/2008 | Wu | |
| 2010/0028180 | A1 | 2/2010 | Gerntsen | |
| 2011/0122602 | A1 * | 5/2011 | Wang | B25B 11/002 362/119 |
| 2012/0013117 | A1 * | 1/2012 | Bernshtein | F16L 37/004 285/9.1 |
| 2017/0167477 | A1 * | 6/2017 | Hermansen | F04B 33/005 |

FOREIGN PATENT DOCUMENTS

EP 2 735 738 A2 5/2014

* cited by examiner

*Primary Examiner* — F. Daniel Lopez
*Assistant Examiner* — Matthew Wiblin
(74) *Attorney, Agent, or Firm* — E. Victor Indiano; Indiano & McConnell LLC

(57) ABSTRACT

An air pump includes a pump body having a base. A hose is coupled to the pump body for conducting air from the pump body. The hose includes a distal end having a coupling attached to the end. The coupling is provided for coupling the hose to an object to be inflated. A magnetic dock member is coupled to the pump body for magnetically receiving the coupling, for maintaining the coupling in a fixed position relative to the pump body during times of non-use of the pump.

8 Claims, 7 Drawing Sheets

MAGNETIC COUPLER FOR AIR PUMP HOSE FITTING

PRIORITY CLAIM

The instant application claims benefit of priority to Joshua Poertner U.S. Provisional Patent Application No. 62/138,140 that was filed on 25 Mar. 2015, and which is fully incorporated herein by reference.

I. TECHNICAL FIELD OF THE INVENTION

The present invention relates to pumps and more particularly to air pumps.

II. BACKGROUND OF THE INVENTION

Traditionally, bicycle floor pumps have used a fork or other interference geometry to hold the chuck or hose of the pump to the pump. In 1946, SILCA SpA, the predecessor of the Applicant invented a handle with two grooves that could be used to hold the hose close to the pump body, which had the added benefit of also keeping the pump handle confined to the body. This feature dramatically improved the portability of the pump.

Later pump designs used a small fork shaped fitting located on the pump barrel to secure the pump hose. Many modern pumps have moved the fork to the base which allows the hose to wrap over the pump handle and be secured at the base.

Although these devices perform their intended functions in a workmanlike manner, room for improvement exists.

III. SUMMARY OF THE INVENTION

In accordance with the present invention, an air pump comprises a pump body having a base. A hose is coupled to the pump body for conducting air from the pump body. The hose includes a distal end having a coupling attached to the end. The coupling is provided for coupling the hose to an object to be inflated. A magnetic dock member is coupled to the pump body for magnetically receiving the coupling, for maintaining the coupling in a fixed position during times of non-use of the pump.

Preferably, the magnetic dock member includes a dock-based portion and a dock wall portion. The dock wall portion extends upwardly, and is provided for interiorly receiving the distal portion of the coupling. The base includes a magnetic member and is disposed and positioned to engage a distal end surface of the coupling.

In a most preferred embodiment, the dock base includes a disc-shaped magnet disposed on the base under a protective plate behind which the disk-shaped magnet is positioned. The protective plate is held in place on the dock member with a cap member that is threadedly engaged to the magnetic dock member.

Also, the present invention preferably uses a magnet located within a recess to create a storage dock for the chuck on a bicycle pump. In the present invention as produced, the magnet is a disc shaped magnet located behind a protective plate and held in place with a threaded on cap.

One feature of the present invention is that the air pump of the present invention includes a magnetic dock member that is provided for magnetically receiving the first coupling. This magnetic dock member has the advantage of providing a secure connection between the hose and the pump body to help maintain the hose in a fixed position when the hose is not being used to pump up an inflatable object.

Additionally, the magnetic coupling provides the user with a means for quickly engaging the coupling to the dock member, and quickly disengaging the coupling from the dock member, thus helping to increase the efficiency of use of the device.

These and other features of the present invention will become apparent to those skilled in the art upon a review of the drawings and detailed description presented below that are believed to describe the best mode of practicing the invention perceived presently by the inventor.

IV. BRIEF DESCRIPTION OF THE DRAWINGS

DETAILED DESCRIPTION OF THE PREFERRED EMBODIMENT

The present invention uses a magnet located within a recess to create a storage dock for the chuck on a bicycle pump. In the present invention as produced, the magnet is a disc shaped magnet located behind a protective plate and held in place with a threaded on cap Traditionally, bicycle floor pumps have employed a fork or other interference geometry to hold the chuck or hose of the pump in a storage or non-use position. In 1946, SILCA SpA invented a handle with two grooves in it that could be used to hold the hose, which had the added benefit of also keeping the pump handle confined to the body. This feature dramatically improved the portability of the pump. Later pump designs used a small fork shaped fitting located on the pump barrel to secure the pump hose.

Many modern pumps have moved the fork to the base which allows the hose to wrap over the pump handle and be secured at the base. However, with this type of fitting, the hose must be flexible enough to be either compressed diametrically in the case of the fork holding the hose, or axially in the case of the hose holding the chuck at the base. In this invention, the chuck is secured by magnet, which allows for the use of hose which is axially and diametrically rigid, in this case a PTFE hose overbraided with stainless steel.

While expensive, an axially and radially rigid hose is very preferable to a more flexible hose, as the more rigid hose will not expand or swell with increasing pressure. This type of more rigid hose is more efficient than traditional more flexible hose as the more rigid hose contains only a fixed volume which ensures the maximum amount of air moves into the tire with each stroke. The more rigid hose, such as the PTFE hose mentioned above, also dramatically improves the feel of the pump from the perspective of the user.

Figure 1:
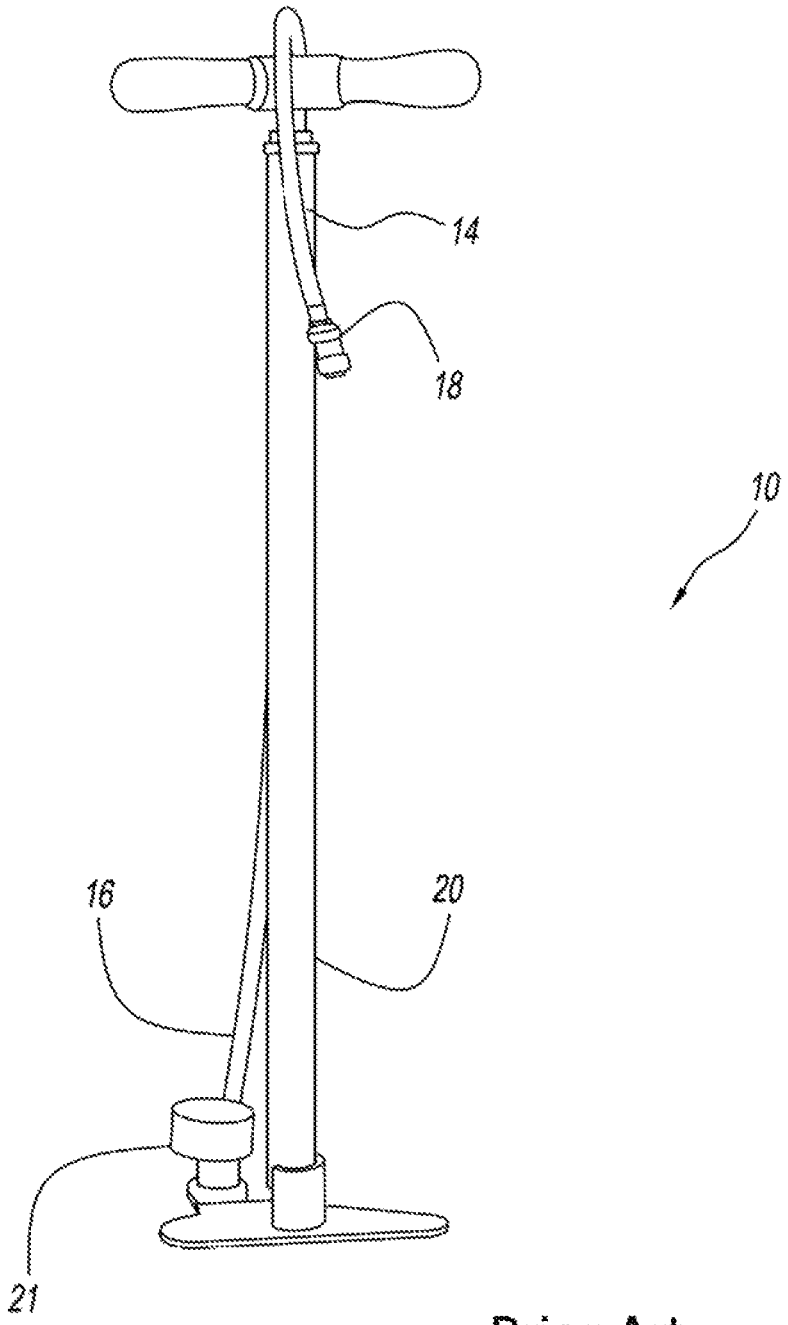
Prior Art FIG. 1
FIG. 1 is a perspective view of a prior art air pump.

FIG. 1 shows a prior art pump 10 having the traditional fork mount 14 that is mounted near the top of the pump 10 barrel 20 for holding the hose 16. The metal chuck 18 swings freely and can scratch or otherwise damage the pump barrel 20. The pump also includes a gauge 21 that provides the user with a reading of the air pressure of the object (e.g. tire) to which the user seeks to add air.

Figure 2:
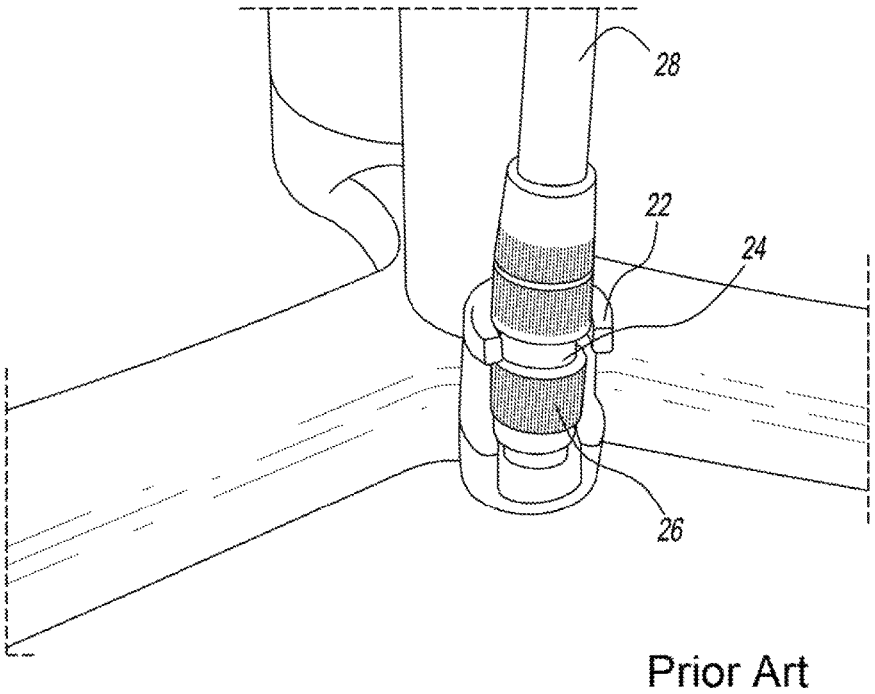
FIG. 2 is a perspective view of a prior art hose coupling of an air pump.

Another embodiment of the prior art traditional mount type is shown in FIG. 2 and comprises a fork 22 mounted to pump foot 23 that captures a flange 24 in the chuck 26. This type of hose mount only works with hose types that are axially extendable as it relies on hose tension to keep the chuck in place. This design also has the disadvantage of requiring the user to not only stretch the hose 28 to insert and remove the chuck 26 each time, which damages the hose 28, but also requires the user to insert or remove the chuck 26 at floor level.

FIGS. 3-9 show the pump 50 of the present invention as including a hose 32 and a gauge 29 that includes the magnetic holder (dock) 36. The chuck 30 may simply be removed from its engagement with magnetic dock 36 by pulling on the hose 32, to separate the hose from the magnet 34 and the magnetic dock 36. The magnet 34 is preferably strong enough so that simply dangling the chuck 30 by the hose 32 in the area of the magnetic dock 36 is enough for the magnetic field of the magnet to capture and draw the chuck 30 into its engaged position.

Figure 3:
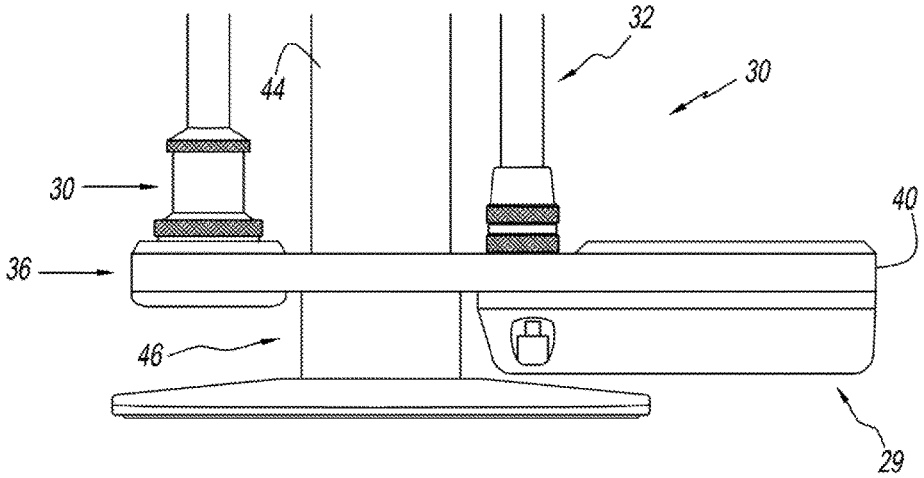
FIG. 3 is a side view of the base portion of the present invention, including the magnetic dock and hose coupling member.

FIG. 3 shows a side view of the magnetic dock 36 of the present invention, wherein the 17-4 stainless steel chuck 30 is attracted to the magnet 34 fixed in the base 40 that is disposed transversely to the axis of the pump body 44, and is coupled thereto near the lower end 46 but above the floor engaging foot member 48.

Figure 4:
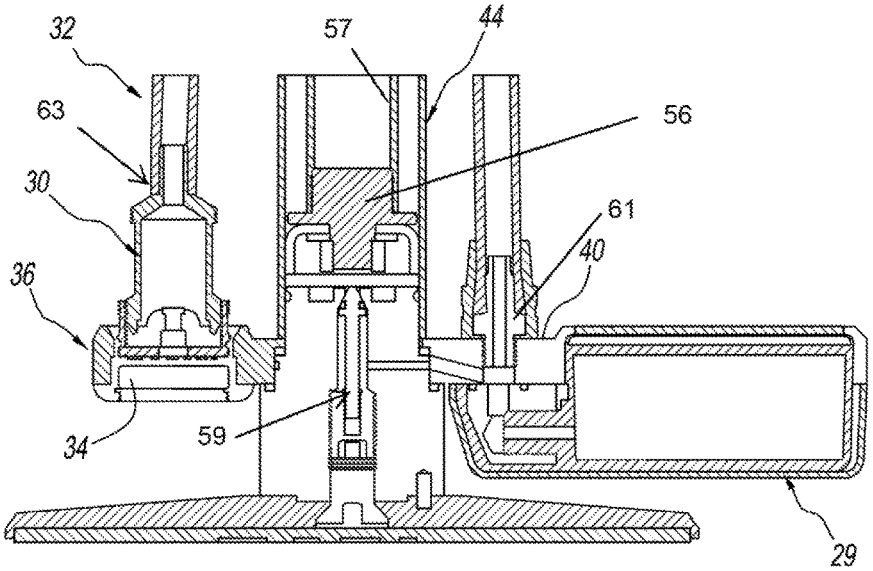
FIG. 4 is a sectional view taken along lines 4-4 of FIG. 3.

FIG. 4 is a cross sectional view of pump 50 of the present invention with the magnetic dock 36 shown for employing magnet 34 to securely couple the chuck 30 to the dock 36. The magnet 34 is preferably a permanent magnet made from a Ferromagnetic or ferrimagnetic material(s).

Figure 5:
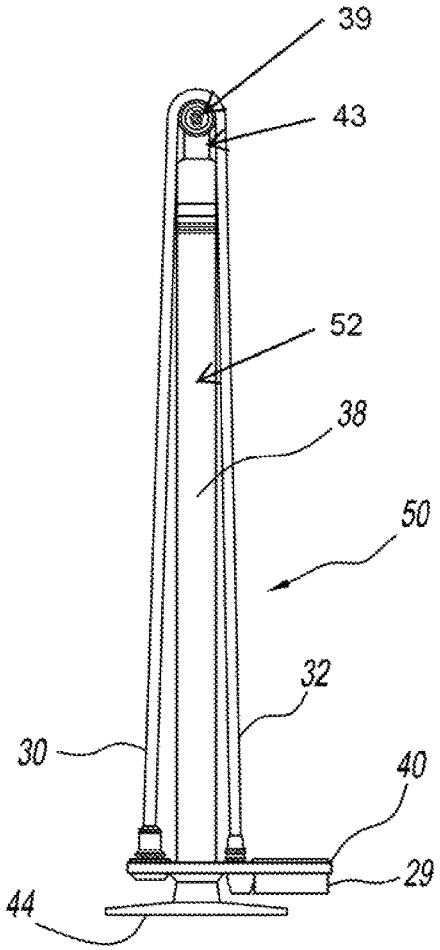
FIG. 5 is a side view of a pump of the present invention.
Figure 6:
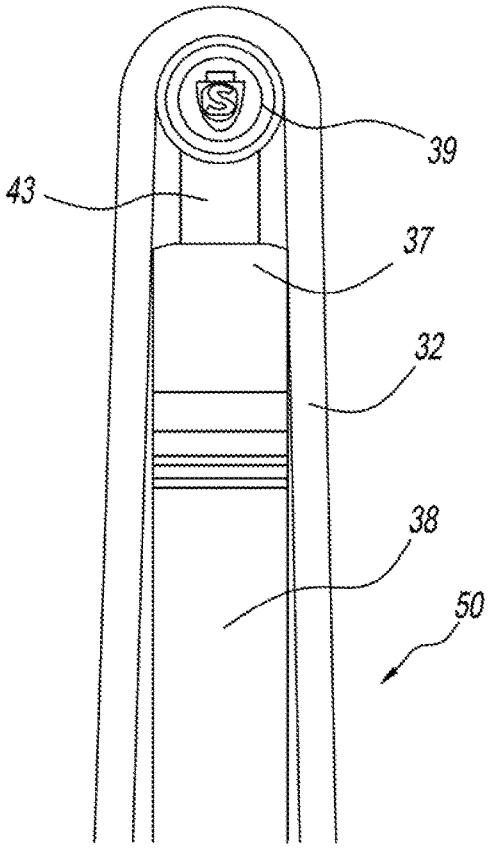
FIG. 6 is a side view of the upper portion of the pump of the present invention showing the hose coupled thereto.

FIGS. 5 and 6 are side views of the full assembly that show the pump 50 having a barrel 38 with an upper end 37 having an aperture for receiving a piston rod 43 topped by a user engaging handle 39.

As best shown in FIGS. 5-8, the pump 50 includes a body 52 including a hollow barrel portion 38, a foot or base portion 44, and a piston member 43 that includes a piston head 56 that is coupled to a shaft 57. Shaft 57 terminates at a handle 39 that is mounted to the exterior end of the shaft 57. The handle moves the shaft 43 and piston head 56 axially so as to cause axial movement of the piston head 56 in a compressive direction to force air through valve 59 and ultimately into the proximal end 61 of hose 32.

A gauge 29 is fluidly coupled to the interior of the hose 32, and is positioned adjacent to the proximal end 61 of the hose 32, so that the gauge 29 can measure the pressure within the interior of the hose 32, and ultimately the interior of the device such as a tire that is being inflated.

The hose 32 is sized to be long enough to extend along the barrel over the handle 39, and thus down along the barrel to the distal end 63 of the hose 32. The distal end 63 of the hose 32 fluidly coupled to the coupling member 30. The coupling member 30 is sized and configured to be selectively magnetically, removeably attachable to the magnet 34 containing clock 36.

Figure 7:
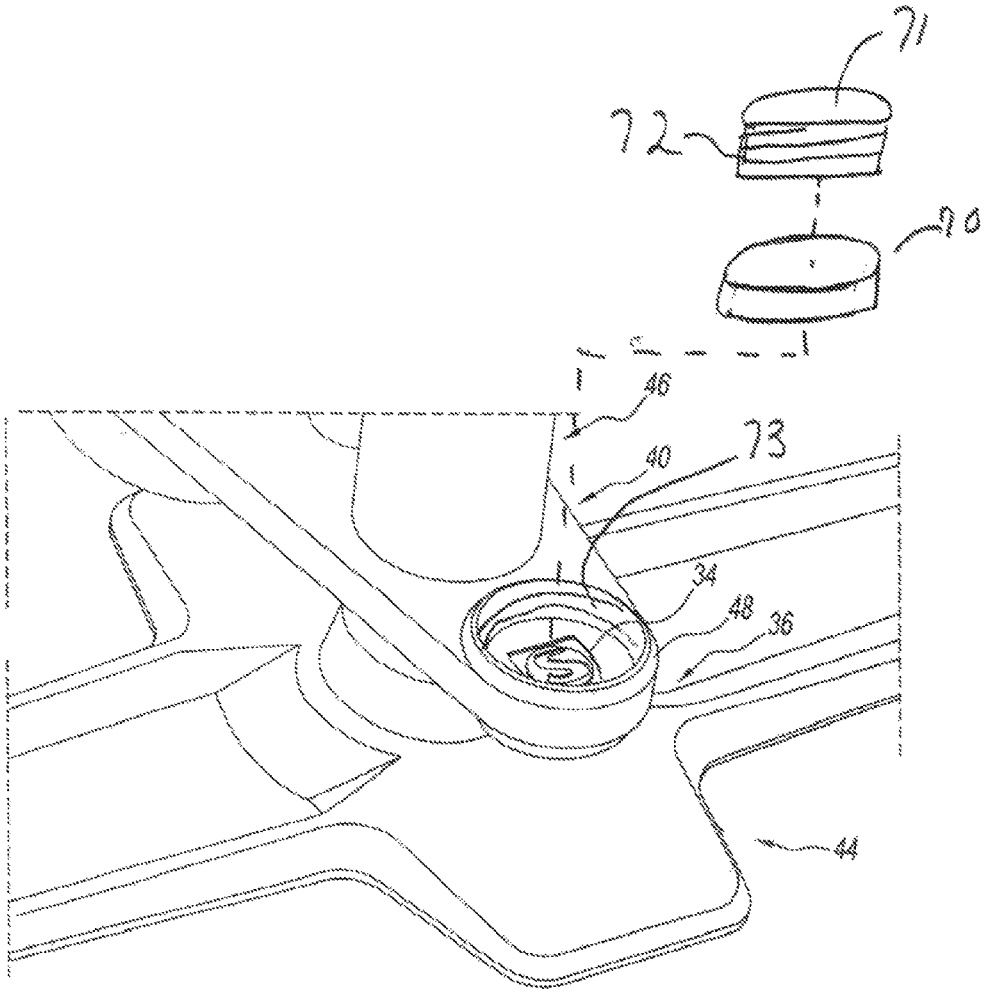
FIG. 7 is a perspective view of the base portion of the present invention, showing the magnetic coupling member, with the hose not coupled thereto.

FIG. 7 is an enlarged, close up view of the foot 44 of the pump 50, the lower portion 41 of the pump 50 and the magnet 34 containing cup 4 of the dock 36. Shown in exploded fashion are a protective plate 70 that may be positioned over the magnet 34 and a threaded cap 71 having threads 72 that may be threadably engaged with threads 73 of the magnetic dock member 36. The protective plate 70 and the threaded cap 71 may have any of a variety of different shapes, sizes, materials, and/or configurations suitable for securing the positions of the magnet 34 and the protective plate 70, including the incorporation of internal and/or external threads.

The cup 48 of the dock 36 provides a rim and a recess 48 into which the distal end of the chuck 30 may be placed to help maintain the chuck 30 within the interior 48 of the cup, along with the force exerted by the magnet 34 that exerts a magnetic force between itself and the cup to maintain the chuck 30 within the cup 48.

Figure 8:
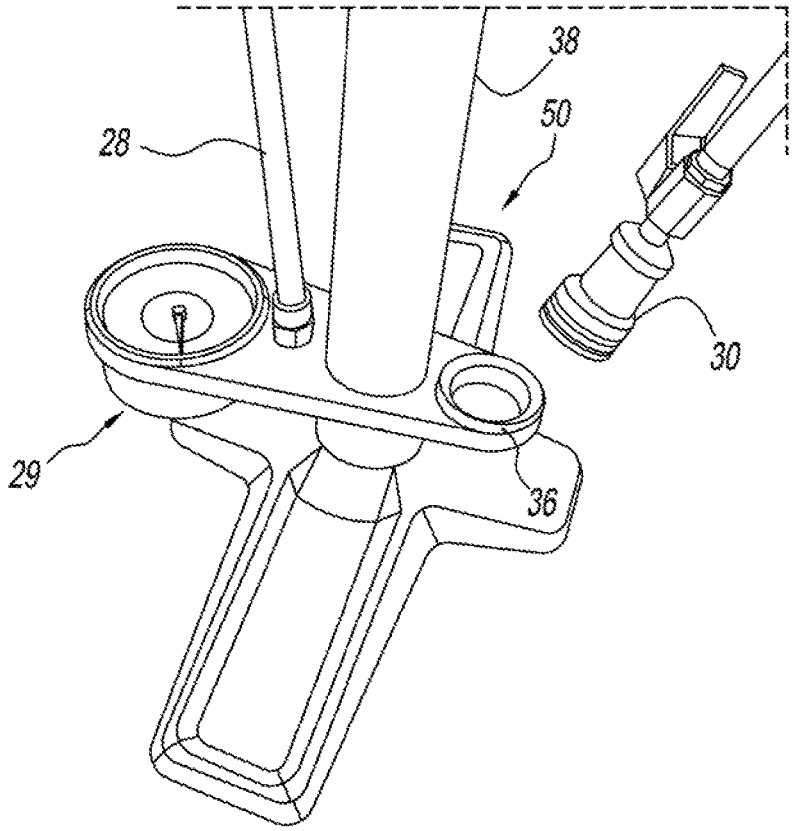
FIG. 8 is another perspective view of the base portion of the hose coupling of the present invention, showing the hose coupling positioned close to the magnetic dock, but not coupled thereto.

Turning now to FIG. 8, the pump 50 includes a hose 32, a barrel 38 having a base 40 disposed near its lower end 46. A gauge 29 and dock 36 are mounted to the base 40. The base 40 extends in a plane that is generally perpendicular to the long axis of the barrel 38 of the pump 50. The base 40 is also disposed in a generally parallel plane with the major extent of the foot 44.

A ground-engaging foot 44 is provided for enabling the pump 50 to be placed in and maintained in an upright position on the ground. When in use, the foot 44 also provides a place upon which the user can rest his foot, to maintain the pump 50 in a fixed position on the flooring surface.

Figure 9:
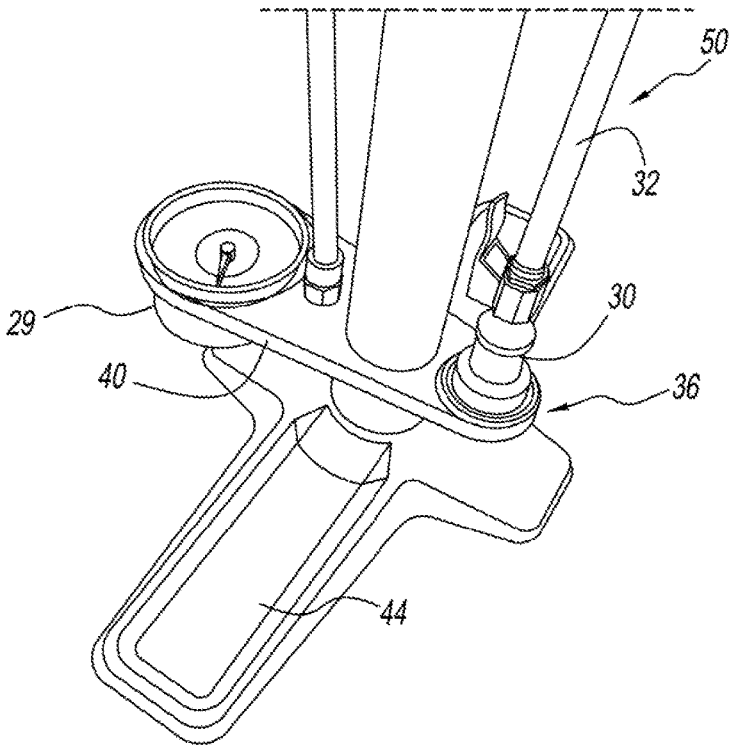
FIG. 9 is a perspective view, similar to FIG. 8, except showing the hose coupling being magnetically coupled to the magnetic dock member.

In FIG. 8, it will be noted that the chuck 30 is spatially separated from the dock 36. When the chuck 30 is placed in this position, or is placed any closer to the dock 36, the magnetic attraction between the chuck 30 and the magnet 34 of the dock will tend to pull the chuck 30 into the engaged position as shown in FIG. 9. When in the engaged position, the chuck 30 is disposed within the cup 48 of the dock 36, so that the distal end of the chuck 30 is disposed adjacent to, or is in engaged with the upper surface of the base, under which is disposed the magnet 34.

To remove the chuck 30, the user simply grabs the hose 32, and pulls the chuck 30 out of engagement with the magnet 34. Once the chuck is spatially separated from the magnet 34, the chuck can easily be moved to any position such as a position on the distal end of the Schraeder Valve or Presta Valve used to inflate a tire.

What is claimed is:

1. An air pump comprising:

a pump body, a base, a hose, a coupling at a distal end of the hose for coupling the hose to an object to be inflated, wherein the distal end is opposite a proximal end of the hose for coupling the hose to the pump body; and a magnetic dock member coupled to the pump body for magnetically receiving the coupling for maintaining the coupling in a fixed position during times of non use of the pump.

2. The air pump of claim 1 wherein the magnetic dock member includes a base member and a wall member.

3. The air pump of claim 2 wherein the wall member is configured for interiorly receiving the coupling.

4. The air pump of claim 3 wherein the coupling includes a distal end surface, and wherein the base member includes a magnetic member for magnetically engaging the distal end surface of the coupling.

5. The air pump of claim 4 wherein the magnetic member is disc-shaped, further comprising a protective plate member positioned to overlay the magnetic member, and be positioned between the magnetic member and the distal end of the coupling.

6. An air pump comprising:

a pump body, a base, a hose, a coupling for coupling the hose to an object to be inflated; and a magnetic dock member coupled to the pump body for magnetically receiving the coupling for maintaining the coupling in a fixed position during times of non use of the pump;

wherein the magnetic dock member includes a base member and a wall member;

wherein the wall member is configured for interiorly receiving the coupling;

wherein the coupling includes a distal end surface, and wherein the base member includes a magnetic member for magnetically engaging the distal end surface of the coupling;

wherein the magnetic member is disc-shaped, further comprising a protective plate member positioned to overlay the magnetic member, and be positioned between the magnetic member and the distal end of the coupling;

wherein the protective plate member is held in place by a cap including threads for threadably engaging the magnetic dock member.

7. The air pump of claim 6 where the hose is axially and radially rigid and is resistant to stretching in either an axial or radial direction.

8. The air pump of claim 7 wherein the hose comprises a PTFE hose overbraided with stainless steel.

* * * * *